US007300244B2

(12) United States Patent
Baugh et al.

(10) Patent No.: US 7,300,244 B2
(45) Date of Patent: Nov. 27, 2007

(54) COOLING FAN NOISE REDUCTION APPARATUS, SYSTEMS, AND METHODS

(75) Inventors: Eric Baugh, Portland, OR (US); Marco Beltman, West Linn, OR (US); Himanshu Pokharna, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 53 days.

(21) Appl. No.: 11/241,259

(22) Filed: Sep. 30, 2005

(65) Prior Publication Data

US 2007/0077139 A1 Apr. 5, 2007

(51) Int. Cl.
*F04D 29/66* (2006.01)

(52) U.S. Cl. ..... 415/119; 416/500

(58) Field of Classification Search ..... 415/119, 415/181, 203, 247 R, 500
See application file for complete search history.

(56) References Cited

U.S. PATENT DOCUMENTS 6,047,765 A * 4/2000 Zhan ..... 165/80.3
6,488,472 B1 * 12/2002 Miyazawa ..... 416/144
6,883,233 B2 * 4/2005 Song et al. ..... 29/888.025

OTHER PUBLICATIONS

"FENESTRON™ Type Tail Rotor, Colibri EC 120B", [online]. Eurocopter. [archived on Feb. 18, 2004]. Retrieved from the Internet: <URL: http://web.archive.org/web/*/http://www.eurocopter.com/site/FO/scripts/siteFO_contenu.php?arbo=2&noeu_id=6&lang=EN>, 4 pgs.

"ORIX® Fan Cooling Fans", [online]. Oriental Motor, © 2003. [retrieved on Aug. 22, 2005]. Retrieved from the Internet: <URL: http://www.orientalmotor.com/products/fan/index_html.htm>, 2 pgs.

"Standard ECMA-74—Measurement of Airborne Noise Emitted by Information Technology and Telecommunications Equipment", [online]. ECMA Standards, Dec. 2003. [retrieved on Aug. 22, 2005]. Retrieved from the Internet: <URL: http://www.ecma-international.org/publications/standards/Ecma-074.htm, 18 pgs.

Akaike, S., et al., "Study of Rotational Noise Reduction for Axial Flow Fan—(Analysis and Estimation of Secondary Fan-Noise Component)", *ISME International Journal, Series B*, 39(3), (1996), 590-596.

Turner, M., et al., "All You Need to Know About Fans", [online]. Electronics Cooling, May 1996. [archived on Sep. 7, 2005]. Retrieved from the Internet: <URL: http://web.archive.org/web/20050907213501/ http://www.electronics-cooling.com/ Resources/EC_Articles/MAY96/ may96_01.htm>, 8 pgs.

* cited by examiner

*Primary Examiner*—Edward K. Look
*Assistant Examiner*—Dwayne J White
(74) *Attorney, Agent, or Firm*—Schwegman, Lundberg & Woessner, P.A.

(57) ABSTRACT

Apparatus, systems, and methods may operate to distribute acoustic spectral energy associated with a primary blade-passing frequency tonal component of fan noise and with harmonics thereof. The energy may be spectrally distributed by irregularly spacing a plurality of fan blades or stationary structures associated with the fan, or both. The stationary structures may be capable of being pressure-coupled to each one of the plurality of fan blades as each fan blade passes by each one of the stationary structures. Other embodiments are described and claimed.

28 Claims, 3 Drawing Sheets

COOLING FAN NOISE REDUCTION APPARATUS, SYSTEMS, AND METHODS

TECHNICAL FIELD

Various embodiments described herein relate to cooling fans generally, including apparatus, systems, and methods used to reduce a perceived tonal content of noise associated with cooling fan operation.

BACKGROUND INFORMATION

Noise associated with information technology (IT) and consumer electronics (CE) devices may become increasingly important as customers desire lower noise systems and environmental regulations become more stringent. Noise from fans or blowers may be a primary contributor of noise associated with these devices.

DETAILED DESCRIPTION

Figure 1:
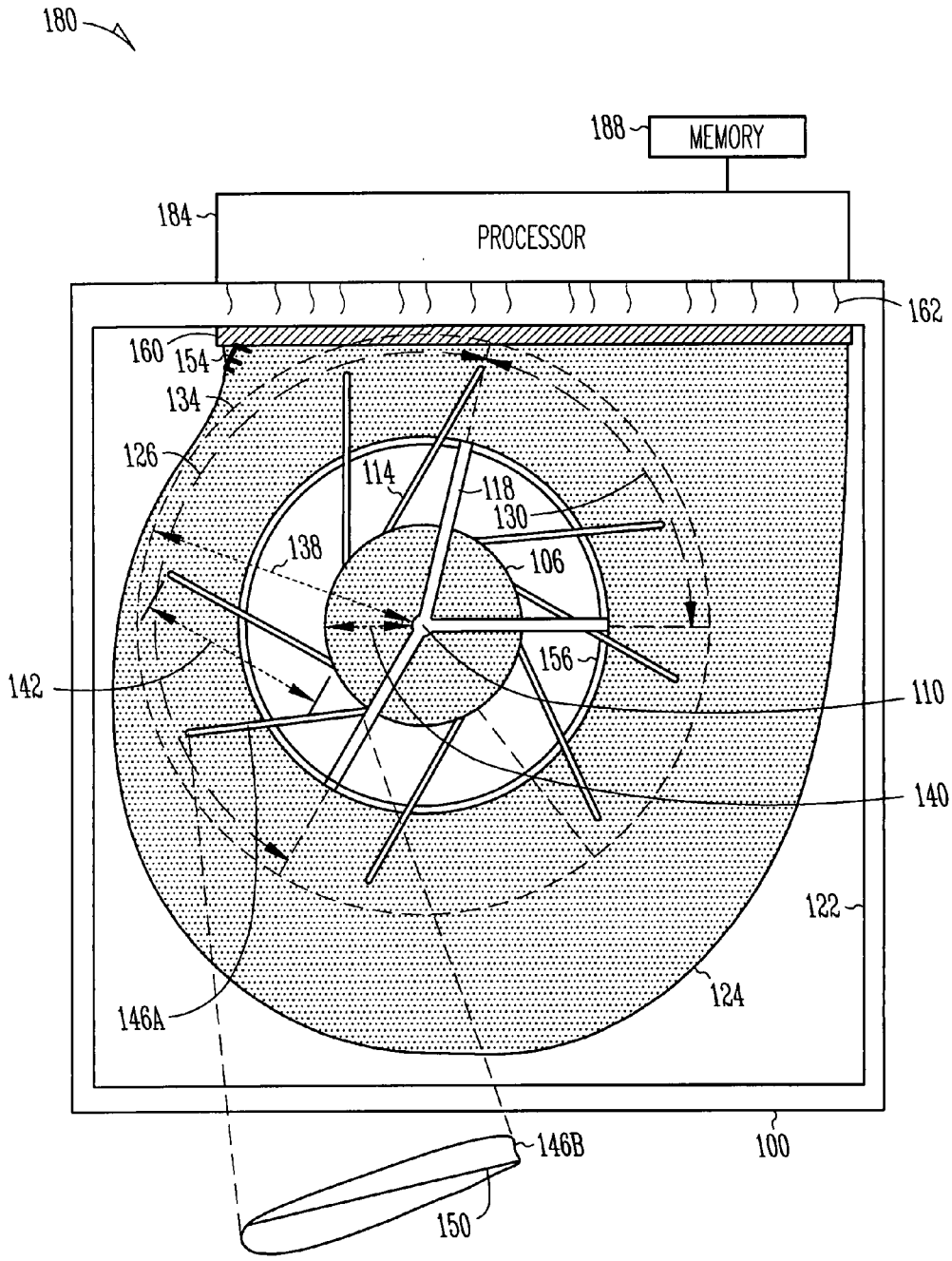
FIG. 1 is a schematic diagram of an apparatus and a representative system according to various embodiments of the invention.

FIG. 1 comprises a schematic diagram of an apparatus 100 and a system 180 according to various embodiments of the invention. Noise may be associated with airflow or with mechanical vibration including "electrical tones" due to motor commutation. Components of noise associated with airflow may include broadband flow noise and tonal components. A primary tonal component may comprise a blade passing frequency (BPF) and harmonics thereof. These quantities may be a function of a number of blades in a fan and a rotational speed of the blades. A frequency spectrum associated with these rotating components may have tonal energy peaks at the BPF and at harmonics of the BPF.

Additional tonal components may be generated as the blades pass by stationary structures including motor support struts, shroud elements, and heat sink fins, among other structures.

Embodiments of the invention may improve a quality of sound emanating from a cooling fan. A perceived tonal component of noise may be reduced by irregularly spacing blades associated with the cooling fan around an axis of rotation. The perceived tonal component may also be reduced by irregularly spacing a set of stationary structures with which the blades interact via air pressure coupling as the blades rotate past the stationary structures.

The term "perceived tonal component" is related to the idea that human perception of a tone may be a function of a power of the tone relative to a nearby acoustic frequency spectrum referred to as the "critical band." Adjusting blade spacing and/or stationary structure spacing to irregular values may operate to spread spectral energy associated with a tone over a range of frequencies. While a total acoustic power associated with a tonal complex may remain unchanged, the perceived tonal component of noise may be reduced. After spreading, each remaining tonal component may be perceived as less prominent relative to the nearby frequency spectrum. Additional information concerning acoustic noise and measurements thereof may be found in ECMA International Standard ECMA-74 Measurement of Airborne Noise Emitted by Information Technology and Telecommunications Equipment $8^{th}$ Edition (December 2003).

The apparatus 100 may include an axial member 106 adapted to rotate about an axis 110 extending along a length of the axial member 106. A plurality of fan blades 114 may be positioned circumferentially about the axial member 106. Each one of the plurality of fan blades 114 may be coupled to the axial member 106.

The apparatus 100 may also include a plurality of stationary structures 118 spaced apart from each other irregularly. Each one of the plurality of stationary structures 118 may be capable of being pressure-coupled to each one of the plurality of fan blades 114 as each one of the plurality of fan blades 114 passes by each one of the plurality of stationary structures 118. The irregular spacing of the stationary structures 118 may operate to distribute acoustic spectral energy associated with a fan 122 comprising the axial member 106. The acoustic spectral energy may include a primary BPF tonal component of noise and harmonics thereof. The fan 122 may comprise an axial flow fan or a centrifugal blower, among other types. The centrifugal blower may include a first shroud 124 to collect air ejected radially from the plurality of fan blades 114 and to redirect the air toward an exit from the fan 122.

A first circumferential path length 126 between ones of a first adjacent pair of the plurality of stationary structures 118 may be unequal to a second circumferential path length 130 between ones of a second adjacent pair of the plurality of stationary structures 118. The first and second circumferential path lengths 126 and 130, respectively, may be located on a circumference 134 centered at the axis 110 in a plane perpendicular to the axis 110. The circumference 134 may correspond to a first radius 138. The first radius 138 may be equal to a second radius 140 associated with the axial member 106 plus a mean blade length 142 associated with the plurality of fan blades 114. The circumference 134 may be measured at other radii. A length of a blade 146A and 146B selected from the plurality of fan blades 114 may be equal to a length of at least one chord 150 associated with the blade 146A and 146B.

The plurality of stationary structures 118 may comprise support elements such as motor support struts. Another example of the plurality of stationary structures 118 may include elements 154 of a second shroud associated with the fan 122. The second shroud may comprise an inlet airflow shroud 156 or an exit airflow shroud 160. A further example of the plurality of support structures 118 may include one or more heat sink fins 162 to be cooled by the fan 122.

Figure 2:
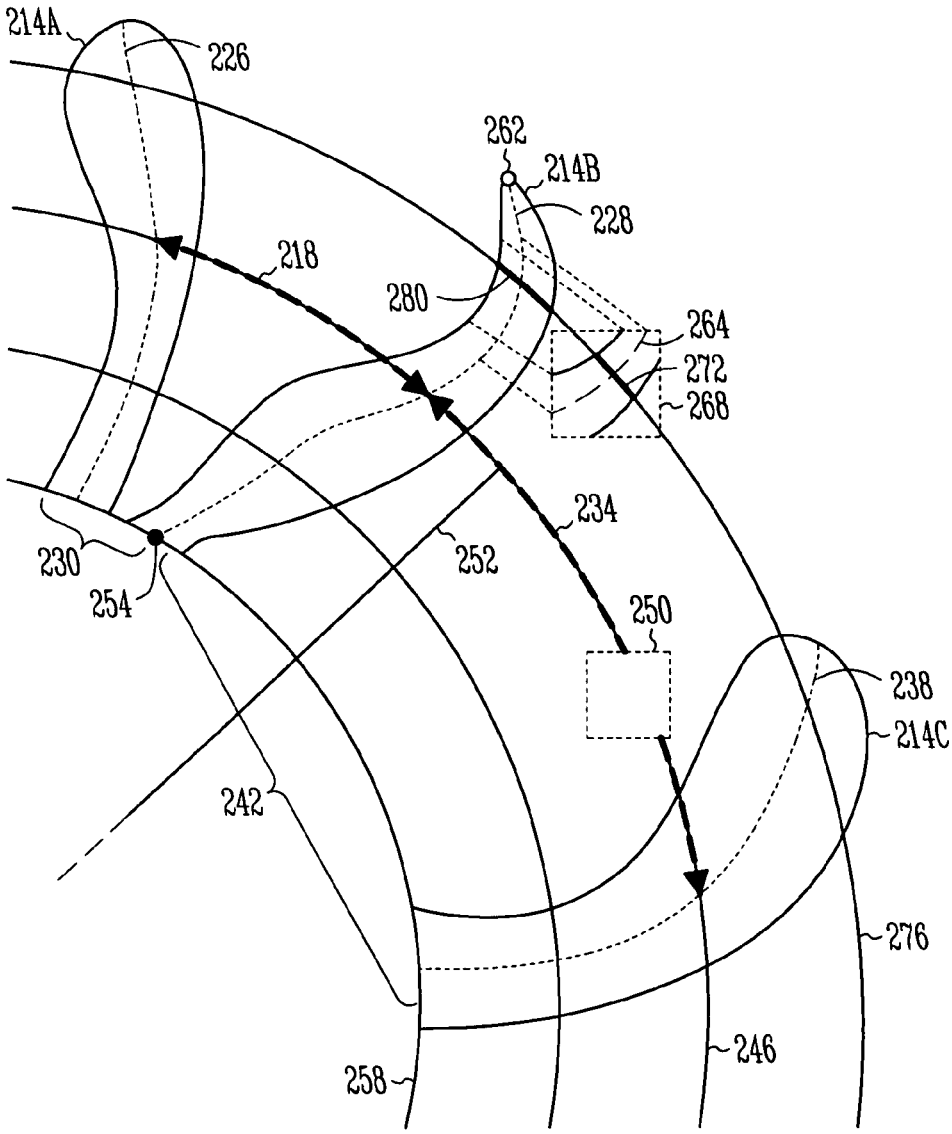
FIG. 2 is a schematic diagram of fan blade details associated with the apparatus and the representative system.

In some embodiments, the plurality of fan blades 114 may be irregularly spaced apart in order to decrease fan blade noise tonality, as previously mentioned. Referring to FIG. 2, one or more of the plurality of fan blades 214A, 214B, and 214C may comprise a twisted blade, a bent blade, a blade of width-to-length ratio greater than one, a blade of variable width-to-length ratio along its length, and a blade of a shape different than that of other blades comprising the plurality of fan blades 214A, 214B, and 214C.

A first circumferential path length 218 may be defined between centerlines 226 and 228 associated with ones of a first adjacent pair 230 of the plurality of fan blades 214A, 214B, and 214C. The first circumferential path length 218 may be unequal to a second circumferential path length 234 between centerlines 228 and 238 associated with ones of a second adjacent pair 242 of the plurality of fan blades 214A, 214B, and 214C. The first and second circumferential path lengths 218 and 234, respectively, may be located on a first circumference 246 centered at the axis of rotation of the plurality of fan blades 214A, 214B, and 214C. The first and second path lengths 218 and 234 may lie in a first plane 250 perpendicular to the axis of rotation. A difference between the first circumferential path length 218 and the second circumferential path length 234 may comprise a function of a radius 252 of the first circumference 246.

The centerlines 226, 228, and 238 may comprise paths along respective ones of the plurality of fan blades 214A, 214B, and 214C. Using the fan blade 214B as an example, the path 228 may begin at a point of connection 254 of the fan blade 214B to an axial member 258. The path 228 may extend along the fan blade 214B to a tip 262 of the fan blade 214B. An orthogonal projection 264 of the path 228 may be made onto a second plane 268 perpendicular to the axis of rotation. The orthogonal projection 264 may bisect a segment 272 of a second circumference 276 centered at the axis of rotation and lying in the second plane 268. The segment 272 may comprise an orthogonal projection of a width 280 of the fan blade 214B onto the second circumference 276.

Referring back to FIG. 1, another embodiment may comprise a system 180. The system 180 may include one or more of the apparatus 100, as previously described. The system 180 may also include a processor 184 thermally coupled to the fan 122, and a memory 188 coupled to the processor 184. The memory 188 may comprise, without limitation, a dynamic random-access memory, a flash memory, and an electrically-alterable read-only memory, among other types. The processor 184 may be cooled by the fan 122. One of ordinary skill in the art will understand that embodiments of the invention may be used to cool other electronic devices, including semiconductor packages, disk drives, switches, etc. without limitation. The memory 188 may comprise working storage for the processor 184.

Any of the components previously described can be implemented in a number of ways, including embodiments in software. Thus, apparatus 100; axial members 106, 258; axis 110; blades 114, 146A, 146B, 214A, 214B, 214C, 230, 242; stationary structures 118; fan 122; shrouds 124, 156, 160; circumferential path lengths 126, 130, 218, 234, 272; circumferences 134, 246, 276; radii 138, 140, 252; blade length 142; chord 150; shroud elements 154; heat sink fins 162; system 180; processor 184; dynamic random-access memory 188; centerlines 226, 228, 238; planes 250, 268; point of connection 254; fan blade tip 262; orthogonal projection 264; and fan blade width 280 may all be characterized as "modules" herein.

The modules may include mechanical elements, hardware circuitry, single or multi-processor circuits, memory circuits, software program modules and objects, firmware, and combinations thereof, as desired by the architect of the apparatus 100 and system 180 and as appropriate for particular implementations of various embodiments.

The apparatus and systems of various embodiments can be used in applications other than reducing a perceived tonal component of noise by irregularly spacing blades and/or stationary structures pressure-coupled to the blades in a cooling fan. Thus, various embodiments of the invention are not to be so limited. The illustrations of apparatus 100 and system 180 are intended to provide a general understanding of the structure of various embodiments. They are not intended to serve as a complete description of all the elements and features of apparatus and systems that might make use of the structures described herein.

Applications that may include the novel apparatus and systems of various embodiments include cooling systems used in high-speed computers, communication and signal processing circuitry, modems, single or multi-processor modules, single or multiple embedded processors, data switches, and application-specific modules, including multilayer, multi-chip modules. Such apparatus and systems may be included as sub-components within a variety of electronic systems, such as televisions, cellular telephones, personal computers (e.g., laptop computers, desktop computers, handheld computers, tablet computers, etc.), workstations, radios, video players, audio players (e.g., mp3 players), vehicles, and others. Some embodiments may include a number of methods.

Figure 3:
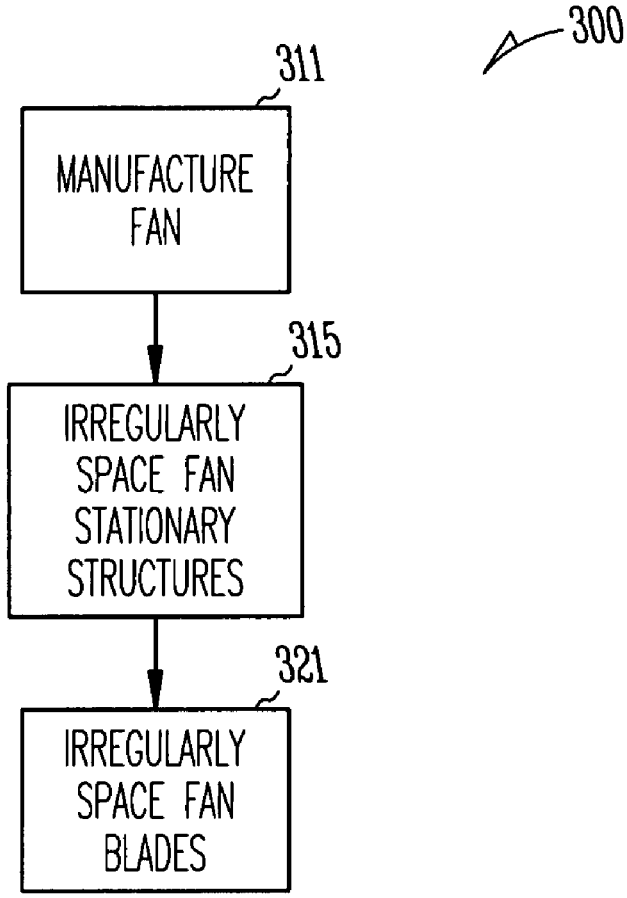
FIG. 3 is a flow diagram illustrating a method according to various embodiments of the invention.

FIG. 3 is a flow diagram illustrating several methods according to various embodiments of the invention. Acoustic energy associated with fan noise may be concentrated at a primary BPF and at harmonics thereof, as previously described. The noise may be associated with an equipment cooling fan, including perhaps a fan associated with an electronic apparatus. The fan may comprise a centrifugal blower or an axial flow fan, among other types. The concentrated acoustic energy may be perceived by equipment users as a bothersome tonal component of noise produced by the fan. A method 200 may include distributing the energy over a wider frequency spectrum in order to reduce the perceived tonal component.

The method 200 may begin at block 311 with manufacturing the fan. The method 200 may continue at block 315 with irregularly spacing a plurality of stationary structures associated with the fan. The stationary structures may include fan motor support struts, fan shroud elements, and heat sink fins, among other structures. The stationary structures may be capable of being pressure-coupled to each one of a plurality of fan blades as the fan blades pass by the stationary structures.

A first circumferential path length may be defined between ones of a first adjacent pair of the plurality of stationary structures. A second circumferential path length may be defined between ones of a second adjacent pair of the plurality of stationary structures. The first circumferential path length may be unequal to the second circumferential path length. The first and second circumferential path lengths may be located on a circumference centered at an axis of rotation associated with the fan blades in a plane perpendicular to the axis of rotation. The circumference may correspond to a first radius. The first radius may be equal to a second radius associated with a hub to which the plurality of fan blades is attached plus a mean blade length associated with the plurality of fan blades. A length of a blade selected from the plurality of fan blades may be equal to a length of one or more chords associated with the selected blade.

The method 200 may also include spacing the plurality of fan blades irregularly about the axis of rotation associated with the fan blades, at block 321. A first circumferential path length may be defined between centerlines associated with ones of a first adjacent pair of the plurality of fan blades. A second circumferential path length may be defined between centerlines associated with ones of a second adjacent pair of the plurality of fan blades. The first and second circumferential path lengths may be unequal. The first and second circumferential path lengths may be located on a first circumference centered at the axis of rotation in a first plane perpendicular to the axis of rotation.

It may be possible to execute the activities described herein in an order other than the order described. And, various activities described with respect to the methods identified herein can be executed in repetitive, serial, or parallel fashion.

The apparatus, systems, and methods disclosed herein may operate to reduce a perceived tonal component of noise associated with a cooling fan by irregularly spacing blades and/or stationary structures pressure-coupled to the blades. An increased level of user satisfaction with products incorporating embodiments of the invention may result.

The accompanying drawings that form a part hereof show, by way of illustration and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein individually or collectively by the term "invention" merely for convenience and without intending to voluntarily limit the scope of this application to any single invention or inventive concept, if more than one is in fact disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to comply with 37 C.F.R. §1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted to require more features than are expressly recited in each claim. Rather, inventive subject matter may be found in less than all features of a single disclosed embodiment. Thus the following claims are hereby incorporated into the Detailed Description, with each claim standing on its own as a separate embodiment.

What is claimed is:

1. An apparatus, including:

an axial member adapted to rotate about an axis extending along a length of the axial member;

a plurality of fan blades positioned circumferentially about the axial member, each one of the plurality of fan blades coupled to the axial member, a first circumferential path length between centerlines associated with ones of a first adjacent pair of the plurality of fan blades is unequal to a second circumferential path length between centerlines associated with ones of a second adjacent pair of the plurality of fan blades, the first and second circumferential path lengths located on a first circumference centered at the axis in a first plane peruendicular to the axis; and a plurality of stationary structures spaced apart from each other irregularly in order to distribute acoustic spectral energy associated with a primary blade-passing frequency (BPF) tonal component of a fan comprising the axial member, wherein each one of the plurality of stationary structures is capable of being pressure-coupled to each one of the plurality of fan blades as each one of the plurality of fan blades passes by each one of the plurality of stationary structures.

2. The apparatus of claim 1, wherein a first circumferential path length between ones of a first adjacent pair of the plurality of stationary structures is unequal to a second circumferential path length between ones of a second adjacent pair of the plurality of stationary structures, wherein the first and second circumferential path lengths are located on a circumference centered at the axis in a plane perpendicular to the axis.

3. The apparatus of claim 2, wherein the circumference corresponds to a first radius, and wherein the first radius is equal to a second radius associated with the axial member plus a mean blade length associated with the plurality of fan blades.

4. The apparatus of claim 3, wherein a length of a blade selected from the plurality of fan blades is equal to a length of at least one chord associated with the blade selected from the plurality of fan blades.

5. The apparatus of claim 1, wherein at least one of the plurality of stationary structures comprises a support element.

6. The apparatus of claim 5, wherein the support element comprises a motor support strut associated with the fan.

7. The apparatus of claim 1, wherein at least one of the plurality of stationary structures comprises an element of a shroud associated with the fan.

8. The apparatus of claim 7, wherein the shroud comprises at least one of an inlet airflow shroud and an outlet airflow shroud.

9. The apparatus of claim 1 wherein the centerline associated with any one of the plurality of fan blades comprises a path extending from a point of connection of the fan blade at the axial member, along the fan blade to a tip of the fan blade, such that an orthogonal projection of the path onto a second plane perpendicular to the axis of rotation bisects a segment of a second circumference centered at the axis, the segment comprising an orthogonal projection of a width of the fan blade onto the second circumference.

10. The apparatus of claim 1 wherein a difference between the first circumferential path length and the second circumferential path length is a function of a radius of the first circumference.

11. The apparatus of claim 1, wherein the fan comprises an axial flow fan.

12. The apparatus of claim 1, wherein the fan comprises a centrifugal blower.

13. An apparatus, including:

an axial member adapted to rotate about an axis extending along a length of the axial member, wherein the axial member is included in a centrifugal blower;

a plurality of fan blades positioned circumferentially about the axial member, each one of the plurality of fan blades coupled to the axial member, wherein a first circumferential path length between centerlines associated with ones of a first adjacent pair of the plurality of fan blades is unequal to a second circumferential path length between centerlines associated with ones of a second adjacent pair of the plurality of fan blades, the first and second circumferential path lengths located on a first circumference centered at the axis in a first plane perpendicular to the axis; and a plurality of stationary structures spaced apart from each other irregularly in order to distribute acoustic spectral energy associated with a primary blade-passing frequency (BPF) tonal component of a fan comprising the axial member, wherein each one of the plurality of stationary structures is capable of being pressure-coupled to each one of the plurality of fan blades as each one of the plurality of fan blades passes by each one of the plurality of stationary structures.

14. The apparatus of claim 13 wherein the centerline associated with any one of the plurality of fan blades comprises a path extending from a point of connection of the fan blade at the axial member, along the fan blade to a tip of the fan blade, such that an orthogonal projection of the path onto a second plane perpendicular to the axis of rotation bisects a segment of a second circumference centered at the axis, the segment comprising an orthogonal projection of a width of the fan blade onto the second circumference.

15. The apparatus of claim 13 wherein a difference between the first circumferential path length and the second circumferential path length is a function of a radius of the first circumference.

16. The apparatus of claim 13, further including:

a shroud to collect air ejected radially from the plurality of fan blades and to redirect the air toward an exit from the blower.

17. A system, including:

an axial member adapted to rotate about an axis extending along a length of the axial member;

a plurality of fan blades positioned circumferentially about the axial member and spaced apart from each other irregularly, each one of the plurality of fan blades coupled to the axial member; and a plurality of stationary structures spaced apart from each other irregularly in order to distribute acoustic spectral energy associated with a primary blade-passing frequency (BPF) tonal component of a fan comprising the axial member, wherein each one of the plurality of stationary structures is capable of being pressure-coupled to each one of the plurality of fan blades as each one of the plurality of fan blades passes by each one of the plurality of stationary structures;

a processor thermally coupled to the fan to be cooled by the fan; and a dynamic random-access memory coupled to the processor to provide working storage.

18. The system of claim 17, wherein a first circumferential path length between ones of a first adjacent pair of the plurality of stationary structures is unequal to a second circumferential path length between ones of a second adjacent pair of the plurality of stationary structures, wherein the first and second circumferential path lengths are located on a circumference centered at the axis in a plane perpendicular to the axis.

19. The system of claim 17, wherein at least one of the plurality of fan blades comprises at least one of a twisted blade, a bent blade, a blade of width-to-length ratio greater than one, a blade of variable width-to-length ratio along its length, and a blade of a shape different than that of other blades comprising the plurality of fan blades.

20. The system of claim 17, wherein at least one of the plurality of stationary structures comprises a heat sink fin to be cooled by the fan.

21. A method, including:

spacing a plurality of fan blades irregularly about an axis of rotation associated with the plurality of fan blades; and distributing acoustic spectral energy associated with a primary blade-passing frequency (BPF) tonal component of fan noise by irregularly spacing a plurality of stationary structures capable of being pressure-coupled to each one of the plurality of fan blades as each one of the plurality of fan blades passes by each one of the plurality of stationary structures.

22. The method of claim 21, wherein a first circumferential path length between ones of a first adjacent pair of the plurality of stationary structures is unequal to a second circumferential path length between ones of a second adjacent pair of the plurality of stationary structures, wherein the first and second circumferential path lengths are located on a circumference centered at an axis of rotation associated with the plurality of fan blades in a plane perpendicular to the axis of rotation.

23. The method of claim 22, wherein the circumference corresponds to a first radius, and wherein the first radius is equal to a second radius associated with a hub to which the plurality of fan blades is attached plus a mean blade length associated with the plurality of fan blades.

24. The method of claim 23, wherein a length of a blade selected from the plurality of fan blades is equal to a length of at least one chord associated with the blade selected from the plurality of fan blades.

25. The method of claim 21, wherein at least one of the plurality of stationary structures comprises at least one of a fan motor support strut, a fan shroud element, and a heat sink fin.

26. The method of claim 21, further including: manufacturing a fan including the fan blades and the stationary structures.

27. The method of claim 26 wherein the fan comprises a centrifugal blower.

28. The method of claim 27, wherein a first circumferential path length between centerlines associated with ones of a first adjacent pair of the plurality of fan blades is unequal to a second circumferential path length between centerlines associated with ones of a second adjacent pair of the plurality of fan blades, the first and second circumferential path lengths located on a first circumference centered at the axis of rotation in a first plane perpendicular to the axis of rotation.

* * * * *

UNITED STATES PATENT AND TRADEMARK OFFICE

CERTIFICATE OF CORRECTION

PATENT NO. : 7,300,244 B2
APPLICATION NO. : 11/241259
DATED : November 27, 2007
INVENTOR(S) : Baugh et al.

It is certified that error appears in the above-identified patent and that said Letters Patent is hereby corrected as shown below:

In column 5, line 67, in Claim 1, delete “peruendicular” and insert -- perpendicular --, therefor.

Signed and Sealed this

Twenty-seventh Day of May, 2008

JON W. DUDAS
*Director of the United States Patent and Trademark Office*